US010801436B2

(12) United States Patent
Kassai et al.

(10) Patent No.: US 10,801,436 B2
(45) Date of Patent: Oct. 13, 2020

(54) CONTROL DEVICE FOR DIRECT FUEL INJECTION ENGINE AND CONTROL METHOD THEREOF

(71) Applicant: NISSAN MOTOR CO., LTD., Yokohama-shi, Kanagawa (JP)

(72) Inventors: Masaharu Kassai, Kanagawa (JP); Takayoshi Kodama, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 16/620,974

(22) PCT Filed: Jun. 15, 2017

(86) PCT No.: PCT/JP2017/022126
§ 371 (c)(1),
(2) Date: Dec. 10, 2019

(87) PCT Pub. No.: WO2018/229932
PCT Pub. Date: Dec. 20, 2018

(65) Prior Publication Data

US 2020/0109682 A1 Apr. 9, 2020

(51) Int. Cl.
*F02D 41/40* (2006.01)
*F02D 41/04* (2006.01)
(Continued)

(52) U.S. Cl.
CPC ..... *F02D 41/402* (2013.01); *F02B 75/048* (2013.01); *F02D 15/02* (2013.01);
(Continued)

(58) Field of Classification Search
CPC ..... F02D 41/3011; F02D 41/3017; F02D 41/3029; F02D 41/3064; F02D 41/402; F02D 37/02; F02P 5/045
See application file for complete search history.

(56) References Cited

U.S. PATENT DOCUMENTS 5,896,840 A 4/1999 Takahashi
6,058,905 A * 5/2000 Nagaishi ..... F02D 33/00 123/295
(Continued)

FOREIGN PATENT DOCUMENTS

JP 10-231746 A 9/1998
JP 2004-60504 A 2/2004
(Continued)

*Primary Examiner* — Sizo B Vilakazi
*Assistant Examiner* — Anthony L Bacon
(74) *Attorney, Agent, or Firm* — Foley & Lardner LLP

(57) ABSTRACT

In a first region on a low load side of an operation region of a direct fuel injection engine, homogenous combustion is performed, while, in a second region of the operation region on a load side higher than the first region, stratified combustion is performed. In the stratified combustion, a fuel is dispersed in a cylinder by a first injection operation and a fuel is unevenly distributed in a vicinity of the ignition plug by a second injection operation. Shift control by the stratified combustion is executed at a time of shifting when an operation state of the engine has shifted from the first region to the second region, and in the shift control, a fuel in an amount larger than a target amount of the second injection operation in the second region is injected by the second injection operation and then, an injection amount of the second injection operation is decreased toward the target amount.

11 Claims, 13 Drawing Sheets

(51) Int. Cl.

| | |
|---|---|
| ***F02D 41/30*** | (2006.01) |
| ***F02P 5/04*** | (2006.01) |
| ***F02P 5/15*** | (2006.01) |
| ***F02D 41/38*** | (2006.01) |
| ***F02B 75/04*** | (2006.01) |
| ***F02D 15/02*** | (2006.01) |

(52) U.S. Cl.
CPC ..... *F02D 41/04* (2013.01); *F02D 41/3029* (2013.01); *F02D 41/3064* (2013.01); *F02P 5/045* (2013.01); *F02P 5/15* (2013.01); *F02D 2041/389* (2013.01)

(56) References Cited

U.S. PATENT DOCUMENTS 6,340,014 B1 * 1/2002 Tomita ..... F02D 41/024 123/295
7,159,543 B2 1/2007 Hotta et al.
2002/0020386 A1 * 2/2002 Ogawa ..... F02B 17/005 123/295
2002/0134081 A1 * 9/2002 Shiraishi ..... F01N 13/009 60/602
2005/0268870 A1 12/2005 Hotta et al.
2006/0137647 A1 * 6/2006 Altenschmidt ..... F02D 41/3029 123/299
2017/0284282 A1 * 10/2017 Ochi ..... F02D 41/40

FOREIGN PATENT DOCUMENTS

JP 2004-245171 A 9/2004
JP 2005-344644 A 12/2005
JP 2006-70863 A 3/2006
JP 2010-37948 A 2/2010
JP 2011-140889 A 7/2011

* cited by examiner

CONTROL DEVICE FOR DIRECT FUEL INJECTION ENGINE AND CONTROL METHOD THEREOF

TECHNICAL FIELD

The present invention relates to a direct fuel injection engine configured capable of switching a combustion form in accordance with an operation region and a control method thereof.

BACKGROUND ART

A demand for improvement of fuel efficiency of an internal combustion engine has increased for further reduction of an environmental load. Leaning of the air-fuel mixture is an already known measure for improving the fuel efficiency of the internal combustion engine. JPH10-231746 discloses the one which switches a combustion form from stratified combustion to homogenous combustion in accordance with an increase in an engine load at acceleration from a low-rotation low-load region, as a direct fuel injection engine configured capable of switching the combustion form in accordance with the operation region. A fuel is injected during an intake stroke in an operation by homogenous combustion and the fuel is injected during a compression stroke in the operation by the stratified combustion. And the fuel is injected both in the intake stroke and the compression stroke particularly in a region on a high load side in the regions where the operation is performed by the stratified combustion.

SUMMARY OF INVENTION

The inventors of the present invention examine that an excess air ratio of an air-fuel mixture is set to a value higher than a stoichiometric air-fuel ratio equivalent value in the entire operation region of an engine, while the operation is performed by homogenous combustion in the operation region on a low load side, and fuel injection is executed a plurality of times in one combustion cycle in the operation region on the high load side so that the fuel is distributed in a cylinder by a first injection operation, and the operation is performed by combustion in which the fuel is biased to a vicinity of an ignition plug by a second injection operation executed with a delay after the first injection operation (hereinafter referred to as "stratified combustion" and also particularly called "slight stratified combustion" in order to be discriminated from stratified combustion in which the fuel injection is performed only during the compression stroke).

Here, in the operation by the stratified combustion, an injection amount of the second injection operation is preferably limited to a small amount from a viewpoint of suppression on NOx emission. And when the homogenous combustion is switched to the stratified combustion in response to the increase in the engine load, if the injection amount of the second injection operation is limited to a small amount immediately after the switching, a sufficient amount of the fuel is not injected as the injection amount of the second injection operation, and combustion becomes unstable in some cases. On the other hand, if the injection amount of the second injection operation is simply increased in order to avoid unstable combustion, not only that NOx emission is increased, but also that there is a concern that the combustion becomes excessively steep.

The present invention has an object to enable appropriate switching from the homogenous combustion to the stratified combustion without losing combustion stability in a direct fuel injection engine configured to perform the homogenous combustion in the operation region on the low load side and to perform the stratified combustion in the operation region on the high load side.

In one aspect of the present invention, a control method of the direct fuel injection engine is provided.

A control method according to this aspect is a method that controls a direct fuel injection engine including an ignition plug and a fuel injection valve arranged to be capable of injecting a fuel directly in a cylinder. In a first region on a low load side of an operation region of the engine, homogenous combustion is performed, while, in a second region of the operation region on a load side higher than the first region, stratified combustion is performed, in the stratified combustion a fuel is dispersed in a cylinder by a first injection operation of the fuel injection valve and the fuel is unevenly distributed in a vicinity of the ignition plug by a second injection operation of the fuel injection valve. Furthermore, shift control by the stratified combustion is executed at a time of shifting the operation region when an operation state of the engine has shifted from the first region to the second region, and in the shift control, a fuel in an amount larger than a target amount of the second injection operation in the second region is injected by the second injection operation and then, an injection amount of the second injection operation is decreased toward the target amount.

In another aspect of the present invention, a control device for a direct fuel injection engine is provided.

DESCRIPTION OF EMBODIMENTS

An embodiment of the present invention will be described below by referring to the attached drawings.

Entire Configuration of Engine

Figure 1:
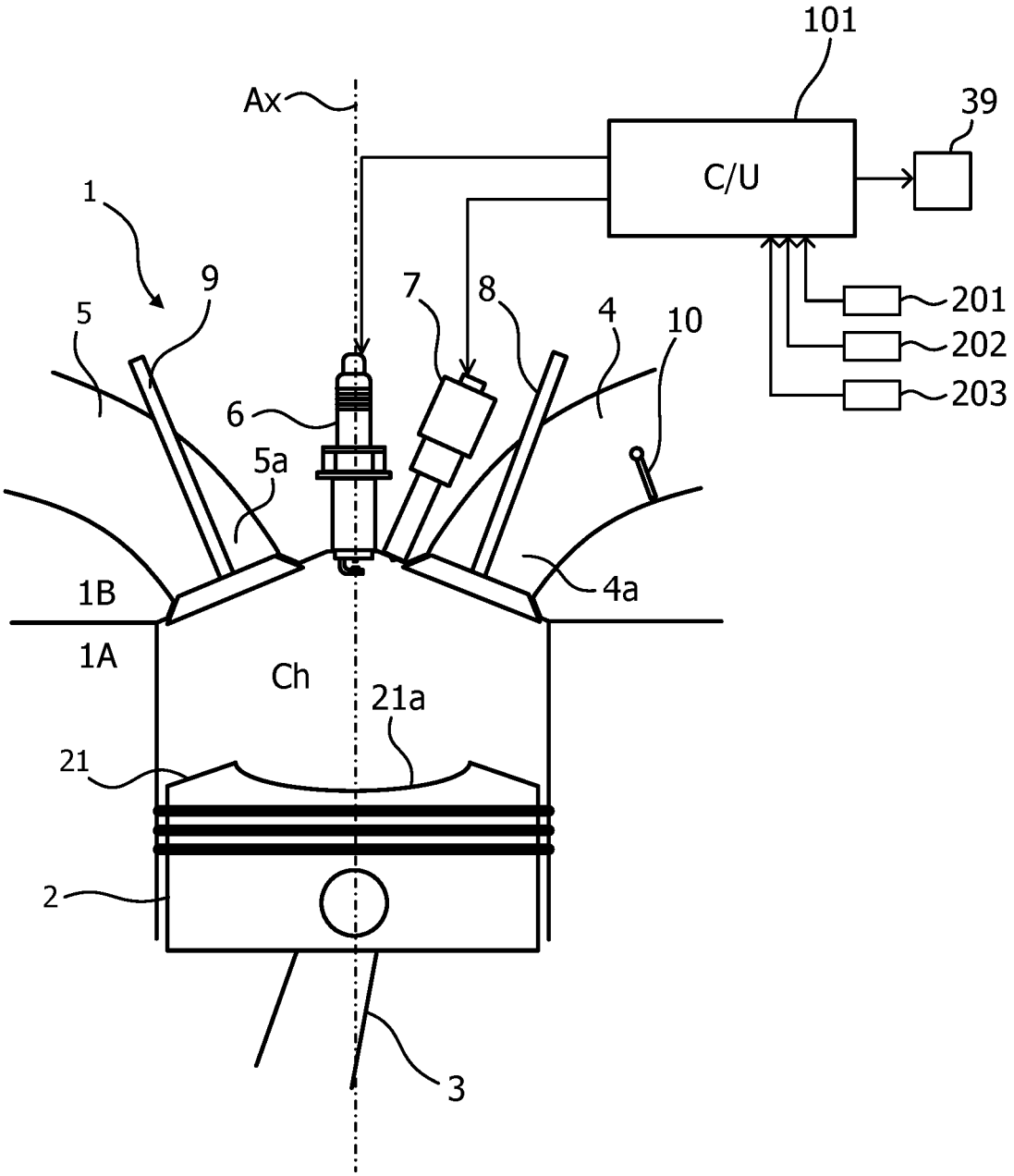
FIG. 1 is a configuration diagram of a direct fuel injection engine according to an embodiment of the present invention.

FIG. 1 is a configuration diagram of a direct fuel injection engine (spark ignition engine and hereinafter, referred to as an "engine") 1 according to an embodiment of the present invention.

The engine 1 has its body formed by a cylinder block 1A and a cylinder head 1B, and a cylinder or an air cylinder is formed as a space surrounded by the cinder block 1A and the cylinder head 1B. FIG. 1 illustrates only one cylinder, but the engine 1 may be a multi-cylinder type direct fuel injection engine having a plurality of cylinders.

A piston 2 is inserted into the cylinder block 1A capable of reciprocating up/down along a cylinder center axis Ax, and the piston 2 is connected to a crank shaft, not shown, through a connecting rod 3. A reciprocating motion of the piston 2 is transmitted to the crank shaft through the connecting rod 3 and is converted to a rotary motion of the crank shaft. A cavity 21*a* is formed in a top surface 21 of the piston 2, and interference of a smooth flow of air sucked into the cylinder through an intake port 4*a* by the piston top surface 21 is suppressed.

A lower surface defining a pent-roof type combustion chamber Ch is formed on the cylinder head 1B. The combustion chamber Ch as a space surrounded by the lower surface of the cylinder head 1B and the piston top surface 21 is formed. A pair of intake passages 4 on one side of the cylinder center axis Ax and a pair of exhaust passages 5 on the other side are formed in the cylinder head 1B as passages allowing the combustion chamber Ch and an outside of the engine to communicate with each other. An intake valve 8 is installed on a port portion (intake port) 4*a* of the intake passage 4, and an exhaust valve 9 is installed on a port portion (exhaust port) 5*a* of the exhaust passage 5. The air taken into the intake passage 4 from the outside of the engine is sucked into the cylinder during an open period of the intake valve 8, and the exhaust gas after combustion is exhausted to the exhaust passage 5 during the open period of the exhaust valve 9. A throttle valve, not shown, is installed in the intake passage 4, and a flowrate of the air taken into the cylinder is controlled by the throttle valve.

An ignition plug 6 is further installed on the cylinder center axis Ax between the intake port 4*a* and the exhaust port 5*a* in the cylinder head 1B, and a fuel injection valve 7 is installed between the pair of intake ports 4*a* and 4*a* on one side of the cylinder center axis Ax. A position of the ignition plug 6 is preferably in the vicinity of the cylinder center axis Ax and is not limited to on the cylinder center axis Ax. The fuel injection valve 7 is configured capable of direct injection of a fuel into the cylinder upon receipt of supply of the fuel from a high-pressure fuel pump, not shown. The fuel injection valve 7 is a multi-hole type fuel injection valve and is disposed on the intake port 4*a* side of the cylinder center axis Ax so that the fuel is injected to a direction diagonally crossing the cylinder center axis Ax, or in other words, so that a spray beam gravity-center line AF which will be described later and the cylinder center axis Ax cross each other at a sharp angle. In this embodiment, the fuel injection valve 7 is provided at a position surrounded by the ignition plug 6 and the intake ports 4*a* and 4*a*. Not limited to such disposition, the fuel injection valve 7 can be installed on a side opposite to the ignition plug 6 with respect to the intake port 4*a*.

A tumble control valve 10 is installed in the intake passage 4, and an opening area of the intake passage 4 is substantially narrowed by the tumble control valve 10, whereby a flow of the air in the cylinder is reinforced. In this embodiment, a tumble flow in which the air taken into the cylinder through the intake port 4*a* passes to the side opposite to the intake port 4*a* with respect to the cylinder center axis Ax, or in other words, passes to the direction from the lower surface of the cylinder head 1B toward the piston top surface 21 through an in-cylinder space on the exhaust port 5*a* side is formed as the air flow, and this tumble flow is reinforced by the tumble control valve 10. The reinforcement of the in-cylinder flow is not limited to installation of the tumble control valve 10 but can be also achieved by changing a shape of the intake passage 4. For example, the shape may be such that the intake passage 4 is brought into a state closer to upright so that the air flows into the cylinder at a gentler angle to the cylinder center axis Ax or that a center axis of the intake passage 4 is brought into a state closer to a straight line so that the air flows into the cylinder with more energy.

An exhaust purifying device (not shown) is interposed in the exhaust passage 5. In this embodiment, a catalyst having an oxidation function and a catalyst having NOx occlusion/reduction function are built in the exhaust purifying device, and the exhaust gas after the combustion exhausted to the exhaust passage 5 has hydrocarbon (HC) purified by oxygen remaining in the exhaust gas and then, a NOx component is occluded and emitted into the atmosphere. As will be described later, in this embodiment, the combustion is performed with the excess air ratio λ of the air-fuel mixture in the vicinity of 2 in the entire operation region of the engine 1, but in a region on a lean side where the excess air ratio λ is higher than a stoichiometric air-fuel ratio equivalent value, emissions of carbon monoxide (CO) and nitrogen oxide (NOx) are reduced, while HC tends to maintain a constant emission. By means of the operation in which the excess air ratio λ is increased so as to have the air-fuel ratio largely higher than the stoichiometric value, emission of HC to the atmosphere can be suppressed while emission itself of NOx is kept low, while a capacity of the occlusion catalyst is suppressed by suppressing emission itself of NOx.

Configuration of Variable Compression Ratio Mechanism

Figure 2:
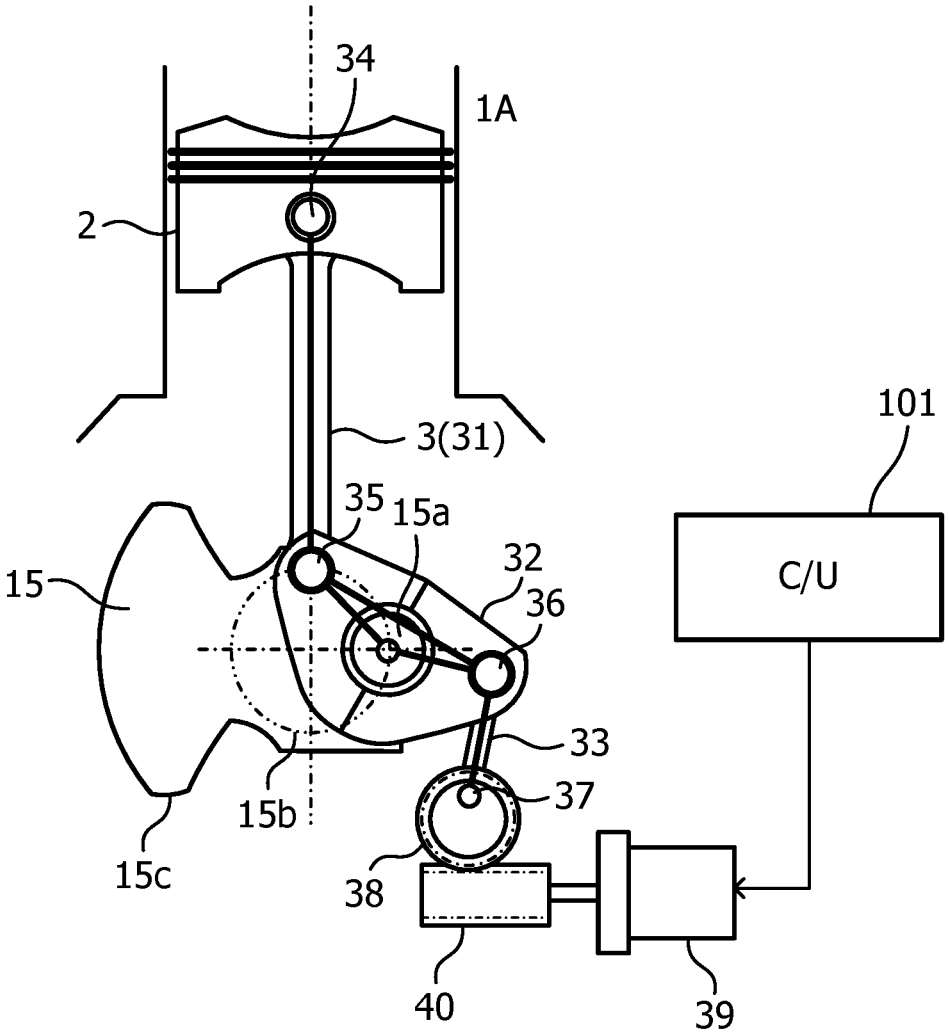
FIG. 2 is a configuration diagram of a variable compression ratio mechanism provided in the engine.

FIG. 2 is a configuration diagram of a variable compression ratio mechanism provided in the engine 1.

In this embodiment, a top dead center position of the piston 2 is changed by the variable compression ratio mechanism, and a compression ratio of the engine 1 is mechanically changed.

The variable compression ratio mechanism changes the compression ratio by connecting the piston 2 and the crank shaft 15 through an upper link 31 (connecting rod 3) and a lower link 32 and by adjusting an attitude of the lower link 32 by a control link 33.

The upper link 31 is connected to the piston 2 by a piston pin 34 on an upper end.

The lower link 32 has a connection hole at a center and is connected to the crank shaft 15 capable of swing around a crank pin 15*a* by inserting the crank pin 15*a* of the crank shaft 15 into this connection hole. The lower link 32 is connected to a lower end of the upper link 31 by a connection pin 35 on one end and is connected to an upper end of the control link 33 by a connection pin 36 on the other end.

The crank shaft 15 includes the crank pin 15*a*, a crank journal 15*b*, and a balance weight 15*c* and is supported by the crank journal 15*b* with respect to the engine body. The crank pin 15*a* is provided at a position biased to the crank journal 15*b*.

The control link 33 is connected to the lower link 32 by a connection pin 36 on the upper end and is connected to the control shaft 38 by a connection pin 37 on the lower end. The control shaft 38 is disposed in parallel with the crank shaft 15, and the connection pin 37 is provided at a position biased from the center. The control shaft 38 has a gear formed on an outer periphery. The gear of the control shaft 38 is engaged with a pinion 40 driven by an actuator 39, and by rotating the pinion 40 by the actuator 39, the control shaft 38 is rotated, and an attitude of the lower link 32 can be changed through movement of the connection pin 37.

Specifically, by rotating the control shaft 38 so that the position of the connection pin 37 is relatively lower than the center of the control shaft 38, the attitude or inclination of the lower link 32 can be changed so that the position of the connection pin 35 is relatively higher than the center of the crank pin 15*a* (the lower link 32 is rotated clockwise in a state illustrated in FIG. 2), and the compression ratio of the engine 1 can be mechanically increased. On the other hand, by rotating the control shaft 38 so that the position of the connection pin 37 is relatively higher than the center of the control shaft 38, the attitude or inclination of the lower link 32 can be changed so that the position of the connection pin 35 is relatively lower than the center of the crank pin 15*a* (the lower link 32 is rotated counterclockwise in the state illustrated in FIG. 2), and the compression ratio of the engine 1 can be mechanically lowered.

In this embodiment, the compression ratio is lowered with respect to the increase in the engine load by the variable compression ratio mechanism.

Configuration of Control System

The operation of the engine 1 is controlled by an engine controller 101.

In this embodiment, the engine controller 101 is configured as an electronic control unit and made of a microcomputer including a central processing unit, various storage devices such as ROM and RAM, an input/output interface and the like.

Detection signals of an accelerator sensor 201, a revolution speed sensor 202, and a cooling water temperature sensor 203 are input into the engine controller 101, and detection signals of an airflow meter, an air-fuel ratio sensor and the like, not shown, are also input.

The accelerator sensor 201 outputs a signal according to an operation amount of an accelerator pedal by an operator. The operation amount of the accelerator pedal is an index of a load requested toward the engine 1.

The revolution speed sensor 202 outputs a signal according to a revolution speed of the engine 1. A crank angle sensor can be employed as the revolution speed sensor 202, and the revolution speed can be detected by converting a unit crank angle signal or a reference crank angle signal output by the crank angle sensor to a revolution number per unit time (engine revolution number).

The cooling water temperature sensor 203 outputs a signal according to a temperature of an engine cooling water. Instead of the temperature of the engine cooling water, a temperature of an engine lubricant oil may be employed.

The engine controller 101 stores map data in which various operation control parameters of the engine 1 such as a load of the engine 1, a fuel injection amount to the operation state such as the revolution speed, the cooling water temperature and the like are assigned, detects the operation state of the engine 1 during an actual operation of the engine 1, sets the fuel injection amount, the fuel injection timing, an ignition timing, a compression ratio and the like by referring to the map data on the basis of that, outputs an instruction signal to driving circuits of the ignition plug 6 and the fuel injection valve 7, and outputs an instruction signal to the actuator 39 of the variable compression ratio mechanism.

Outline of Combustion Control

In this embodiment, the engine 1 is operated with the excess air ratio λ of the air-fuel mixture in the vicinity of 2. The "excess air ratio" is a value obtained by dividing the air-fuel ratio by a stoichiometric air-fuel ratio, and when the excess air ratio is "in the vicinity of 2", the excess air ratio of 2 and its vicinity are included, and in this embodiment, the excess air ratio within a range from 28 to 32 in the air-fuel ratio conversion or preferably the excess air ratio which is 30 in the air-fuel ratio conversion is employed. The "excess air ratio of the air-fuel mixture" refers to the excess air ratio in the entire cylinder and more specifically refers to a value obtained by dividing an actually supplied air amount by a minimum air amount on the basis of the minimum air amount (mass) theoretically required for combustion of the fuel supplied per combustion cycle to the engine 1.

Figure 3:
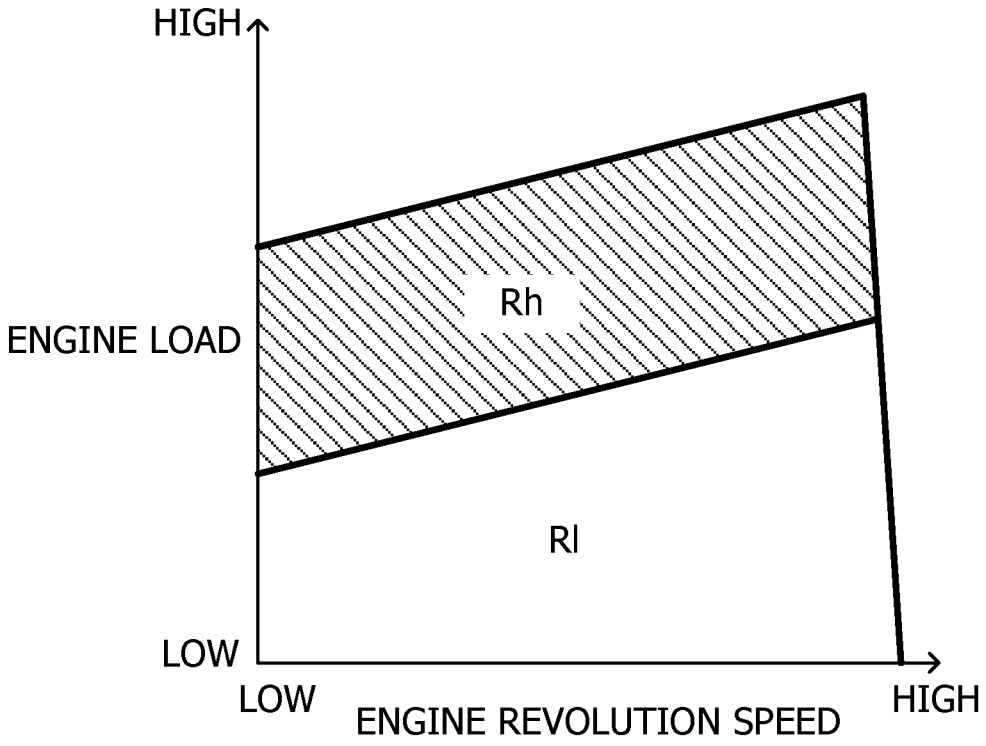
FIG. 3 is an explanatory view illustrating an example of an operation region map of the engine.

FIG. 3 illustrates an operation region map of the engine 1 according to this embodiment.

In this embodiment, the excess air ratio λ of the air-fuel mixture is set to the vicinity of 2 in the entire region where the engine 1 is actually operated regardless of the engine load. The region of the operation with the excess air ratio λ in the vicinity of 2 is not limited to the entire operation region of the engine 1 but may be a part of the operation region. For example, the excess air ratio λ can be set to the vicinity of 2 in a low load region and a middle load region in the entire operation region, and the excess air ratio λ may be switched in a high load region and set to the stoichiometric air-fuel ratio equivalent value (=1).

In the operation region where the excess air ratio λ is set to the vicinity of 2, in this embodiment, in a first region Rl where the engine load is at a predetermined value or less in the entire operation region of the engine 1, the excess air ratio λ is set to a first predetermined value λ1 in the vicinity of 2, and combustion is performed by forming a homogenous air-fuel mixture in which the fuel is diffused in the entire cylinder. On the other hand, in a second region Rh where the engine load is higher than the predetermined value, the excess air ratio λ is set to a second predetermined value λ2 in the vicinity of 2, a stratified air-fuel mixture in which the air-fuel mixture with rich fuel (first air-fuel mixture) is unevenly distributed in the vicinity of the ignition plug 6, and an air-fuel mixture with a fuel leaner than the first air-fuel mixture (second air-fuel mixture) is distributed in the periphery thereof is formed, and the combustion is performed.

In order to form the stratified air-fuel mixture, the fuel having the excess air ratio at the second predetermined value (λ=λ2) is injected in a plurality of number of times in one combustion cycle in this embodiment. A part of the fuel per combustion cycle is injected by a first injection operation at a first timing from an intake stroke to a first half of a compression stroke, and at least a part of the remaining fuel is injected by a second injection operation at a timing later than the first timing with respect to the crank angle, or more specifically, at a second timing immediately before the ignition timing of the ignition plug 6 in a second half of the compression stroke. In this embodiment, since the ignition timing is set during the compression stroke, the second timing is also a timing during the compression stroke.

Figure 4:
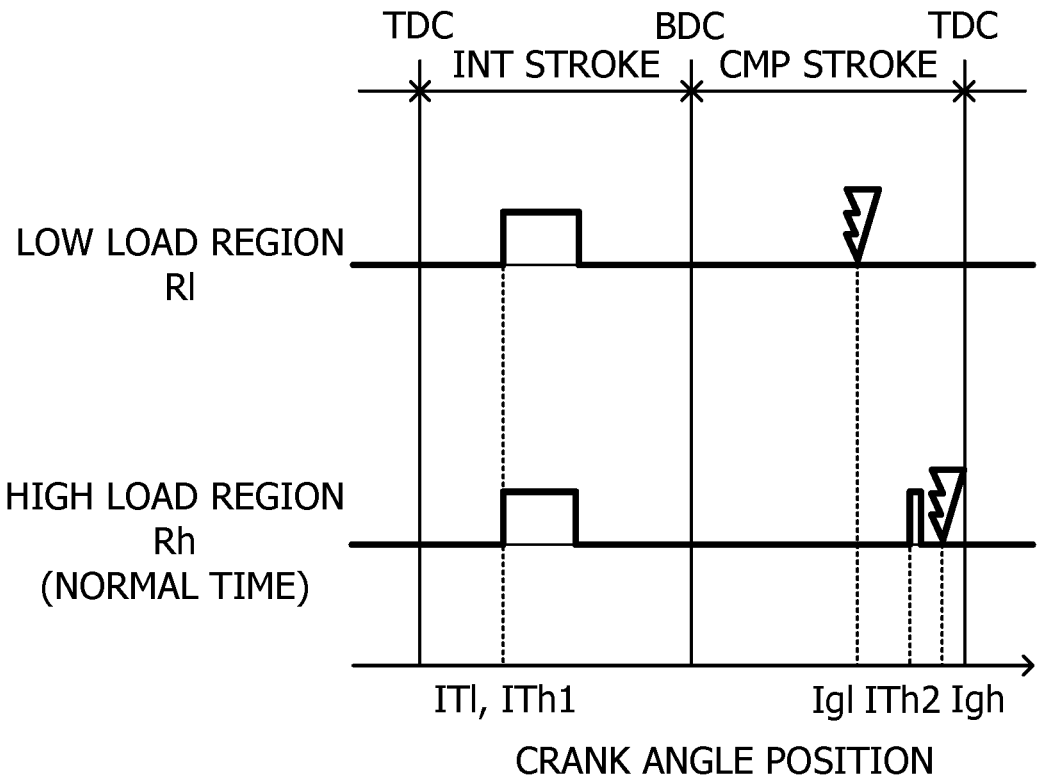
FIG. 4 is an explanatory view illustrating a fuel injection timing and an ignition timing according to the operation region.

FIG. 4 illustrates a fuel injection timing IT and an ignition timing Ig according to the operation region.

In a first region Rl (low load region) where the operation is performed with homogenous combustion, the fuel per combustion cycle is supplied in one injection operation performed during the intake stroke. The engine controller 101 sets a fuel injection timing ITl during the intake stroke and outputs an injection pulse continuing over a period of time according to the fuel injection amount from the fuel injection timing ITl to the fuel injection valve 7. The fuel injection valve 7 is opened/driven by the injection pulse and injects the fuel. In the first region Rl, the ignition timing Igl is set during the compression stroke.

On the other hand, in the second region Rh (high load region) where the operation is performed with stratified combustion, the fuel per combustion cycle is injected by being divided into twice, that is, during the intake stroke and the compression stroke. Approximately 90% of the entire fuel injection amount of the fuel is injected by the first injection operation which is a first injection operation and the remaining 10% of the fuel is injected by the second injection operation which is a second injection operation. The injection amount in the second injection operation is not limited to an amount corresponding to 10% of the entire fuel injection amount but may be an amount as small as possible in view of an operation characteristic of the fuel injection valve 7. The engine controller 101 sets a first timing ITh1 during the intake stroke and a second timing ITh2 during the compression stroke as the fuel injection timing and outputs the injection pulse continuing over the period of time according to the fuel injection amount each time to the fuel injection valve 7. The fuel injection valve 7 is opened/driven by the injection pulse and injects the fuel at each of the first timing ITh1 and the second timing ITh2. The ignition timing Igh is set during the compression stroke in the second region Rh, too, but is set later than the ignition timing Igl in the first region Rl.

The excess air ratio λ (first predetermined value λ1) set in the first region Rl on the low load side and the excess air ratio λ (second predetermined value λ2) set in the second region Rh on the high load side can be set appropriately by considering heat efficiency of the engine 1, respectively. The first predetermined value λ1 and the second predetermined value λ2 may be values different from each other but may be equal values. In this embodiment, they are assumed to be equal values (λ1=λ2).

Description of Fuel Spraying

Figure 5:
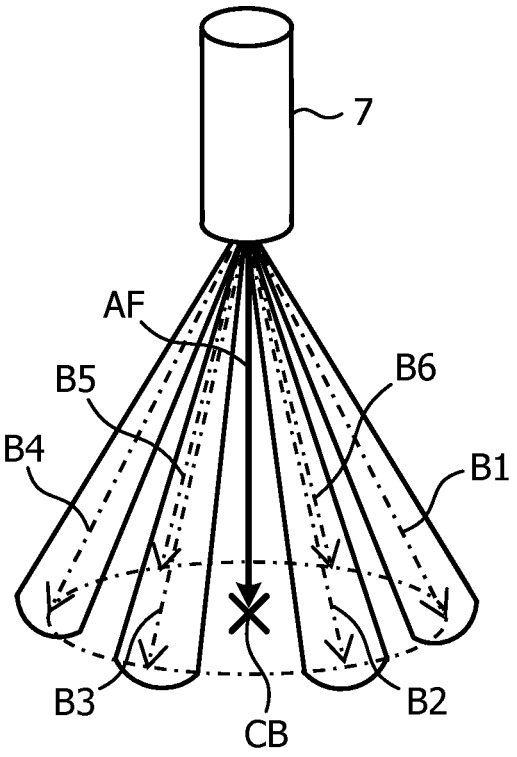
FIG. 5 is an explanatory view illustrating a spray beam gravity-center line of a fuel injection valve.

FIG. 5 illustrates a spray beam gravity-center line AF of the fuel injection valve 7.

As described above, the fuel injection valve 7 is a multi-hole type fuel injection valve and in this embodiment, it has six injection holes. The spray beam gravity-center line AF is defined as a straight line connecting a distal end of the fuel injection valve 7 and a spray beam center CB, and an injection direction of the fuel injection valve 7 is specified as a direction along the spray beam gravity-center line AF. The "spray beam center" CB refers to a center of a virtual circle connecting distal ends of each of spray beams B1 to B6 at a time point when a certain period of time has elapsed since injection, assuming that the spray beams B1 to B6 are formed by the fuel injected by each of the injection holes.

Figure 6:
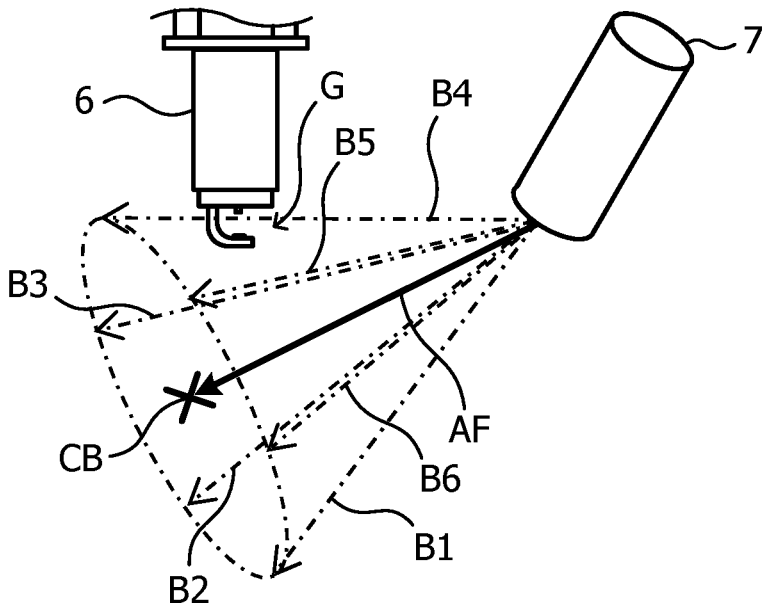
FIG. 6 is an explanatory view illustrating a position relationship between spraying and an ignition plug.

FIG. 6 illustrates a position relationship between the spray (spray beams B1 to B6) and the distal end of the ignition plug 6 (plug gap G).

In this embodiment, the spray beam gravity-center line AF is tilted to a center axis of the fuel injection valve 7, and an angle formed by the cylinder center axis Ax and the spray beam gravity-center line AF is enlarged to be larger than the angle formed by the cylinder center axis Ax and the center axis of the fuel injection valve 7. As a result, the spray can be brought close to the ignition plug 6 and directed so that the spray beam (the spray beam B4, for example) can pass in the vicinity of the plug gap G. The number of spray beams passing in the vicinity of the plug gap G is not limited to one but may be plural and may be configured so as to sandwich the plug gap G by two spray beams, for example.

As described above, by causing the spray beam to pass in the vicinity of the plug gap G, fluidity can be generated in the air-fuel mixture in the vicinity of the ignition plug 6 by kinetic energy of the fuel spray injected immediately before the ignition timing Igh in the second region Rh on the high load side, and by enriching the fuel contained in the air-fuel mixture in the vicinity of the ignition plug 6, a plug discharge channel by ignition can be sufficiently extended even after the tumble flow is damped or collapsed, and ignitability can be ensured. The "plug discharge channel" refers to an arc generated in the plug gap G at ignition.

Description Using Flowchart

Figure 7:
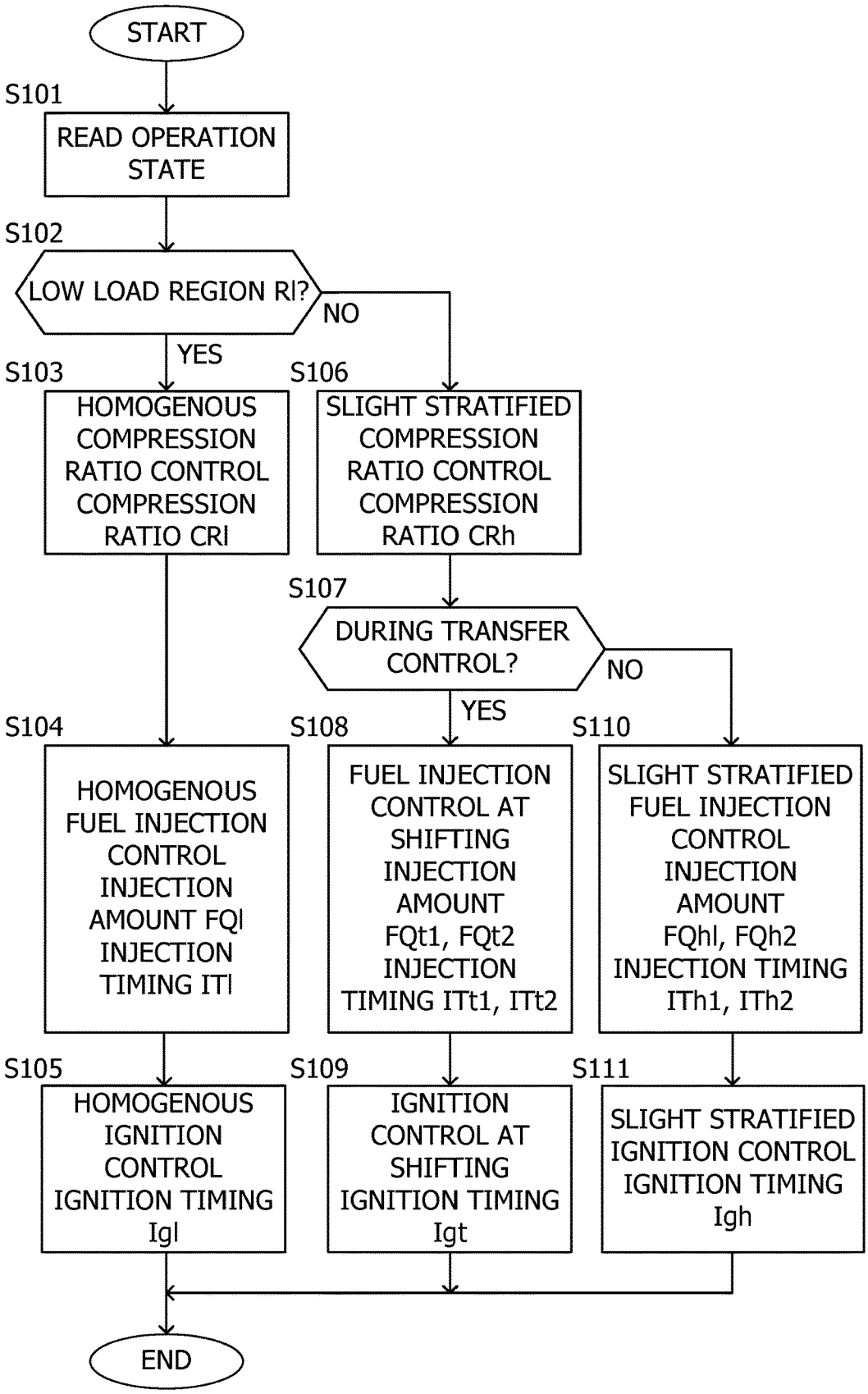
FIG. 7 is a flowchart illustrating a general flow of combustion control (including control at a time of shifting region) according to the embodiment of the present invention.

FIG. 7 illustrates an entire flow of the combustion control according to this embodiment by a flowchart. The combustion control includes control executed at a time of shifting region according to this embodiment (hereinafter, referred to as "shift control").

Figure 8:
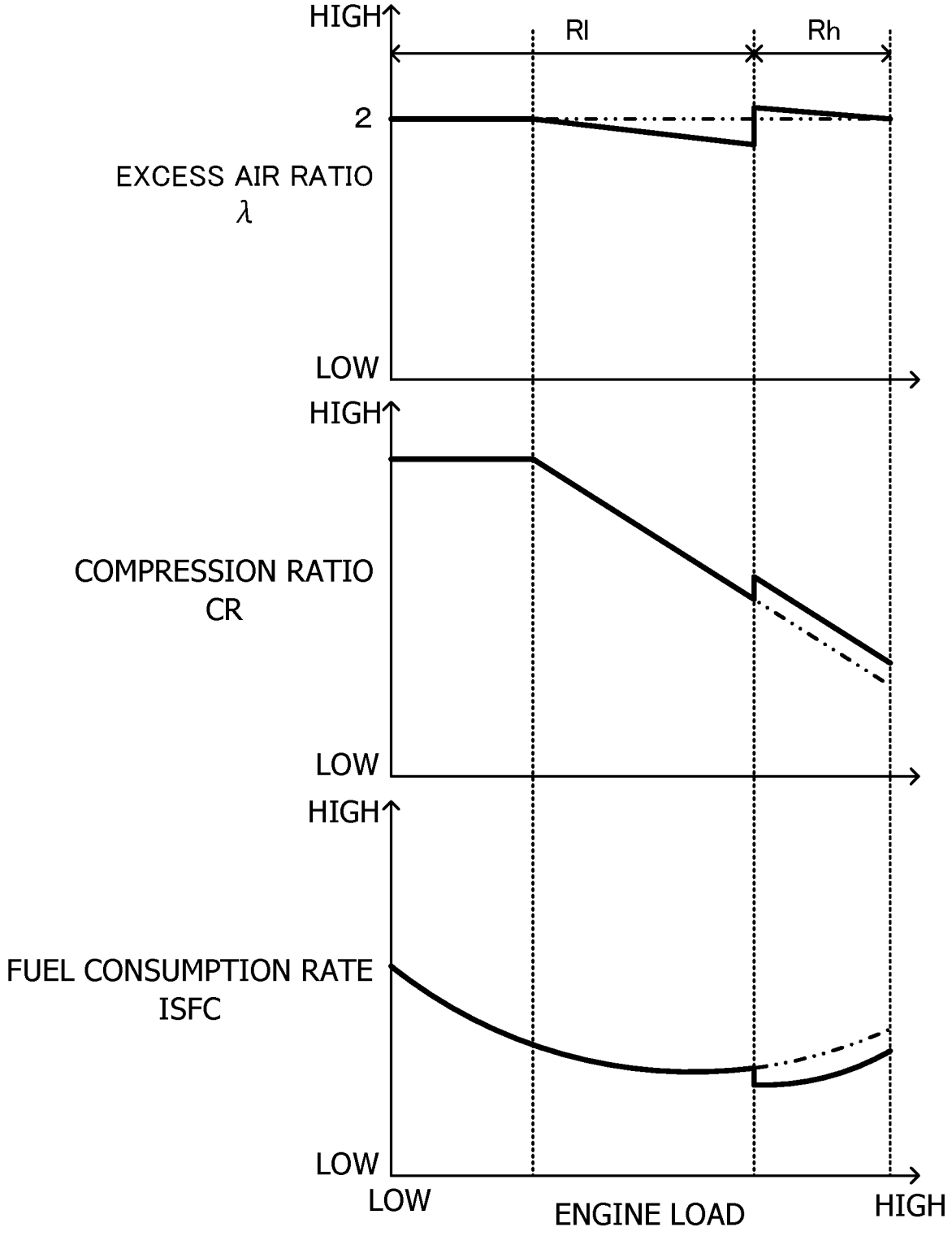
FIG. 8 is an explanatory view illustrating an example of changes in an excess air ratio, a compression ratio, and a fuel consumption rate to an engine load.

FIG. 8 illustrates a change in the excess air ratio λ, a compression ratio CR and a fuel consumption rate ISFC to the engine load.

The combustion control according to this embodiment will be described by using FIG. 7 while referring to FIG. 8 as appropriate. The engine controller 101 is programed to execute a control routine illustrated in FIG. 7 at each predetermined time.

In this embodiment, in addition to switching of the combustion form (homogenous combustion, stratified combustion) described above, compression ratios CRl and CRh of the engine 1 are changed in accordance with the operation regions Rl and Rh by the variable compression ratio mechanism.

At S101, an accelerator position (accelerator opening degree) APO, an engine revolution speed Ne, a cooling water temperature Tw and the like are read as the operation state of the engine 1. The operation state such as the accelerator position APO is calculated by an operation state calculation routine executed separately on the basis of the detection signals of the accelerator sensor 201, the revolution speed sensor 202, the cooling water temperature sensor 203 and the like.

At S102, it is determined whether the operation region of the engine 1 is the first region Rl on the low load side or not on the basis of the read operation state. Specifically, if the accelerator position APO is at a predetermined value or less determined for each engine revolution speed Ne, it is determined that the operation region is the first region Rl, processing proceeds to S103, and the engine 1 is operated by homogenous combustion in accordance with a procedure at S103 to 105. On the other hand, if the accelerator position APO is higher than the predetermined value for the aforementioned each engine revolution speed Ne, it is determined that the operation region is the second region Rh on the high load side, processing proceeds to S106, and the engine 1 is operated by slight stratified combustion in accordance with the procedure at S106 to 111. In this embodiment, shift control is realized by processing illustrated at S107 to 109.

At S103, the compression ratio CRl for the first region Rl is set. In the first region Rl, the compression ratio CRl is set to a value as large as possible within a range where knocking does not occur. In this embodiment, as illustrated in FIG. 8, a target compression ratio having a tendency to lower with respect to an increase in the engine load is set in advance, and the higher the engine load is, the more the compression ratio CRl is lowered by controlling the variable compression ratio mechanism on the basis of the target compression ratio. However, this is not limiting, and it may be so configured that a knock sensor is installed in the engine 1, and the variable compression ratio mechanism is made to lower the compression ratio CRl when occurrence of knocking is detected under the target compression ratio set as a constant value so that the knocking is suppressed.

At S104, the fuel injection amount FQ1 and the fuel injection timing ITl for the first region Rl are set. Specifically, the fuel injection amount FQ1 is set on the basis of the load, the revolution speed and the like of the engine 1, and the fuel injection timing ITl is set. The setting of the fuel injection amount FQ1 and the like is as follows, for example.

A basic fuel injection amount FQbase is calculated on the basis of the accelerator position APO and the engine revolution speed Ne, and the fuel injection amount FQ per combustion cycle is calculated by applying correction according to the cooling water temperature Tw or the like to the basic fuel injection amount FQbase. And the calculated fuel injection amount FQ (=FQ1) is substituted in the following equation so as to convert it to an injection period or an injection pulse width Δt and moreover, the fuel injection timing 1Tl is calculated. The calculation of the basic fuel injection amount FQbase and the fuel injection timing ITl can be made by searching from a map determined in advance by adaptation through experiments and the like.

$$FQ=\rho*A*Cd*\sqrt{\{(Pf-Pa)/\rho\}}*\Delta t \quad (1)$$

In the aforementioned equation (1), it is assumed that the fuel injection amount is FQ, a fuel density is ρ, an injection nozzle total area is A, a nozzle flowrate coefficient is Cd, a fuel injection pressure or a fuel pressure is Pf, and an in-cylinder pressure is Pa.

At S105, the ignition timing Igl for the first region Rl is set. In the first region Rl, the ignition timing Igl during the compression stroke is set. Specifically, the ignition timing Igl is set to MBT (minimum advance for best torque) or timing in the vicinity thereof.

At S106, the compression ratio CRh for the second region Rh is set. In the second region Rh, the compression ratio CRh is set to the compression ratio lower than the first region Rl. Then, similarly to that in the first region Rl, a target compression ratio having a tendency to lower with respect to the increase in the engine load is set in advance, and the compression ratio CRh is lowered by controlling the variable compression ratio mechanism on the basis of the target compression ratio, but if a knock sensor is provided, it may be so configured that the variable compression ratio mechanism is made to lower the compression ratio CRh when occurrence of knocking is detected under the target compression ratio set as a constant value (lower than the value set in the first region Rl) so that the knocking is suppressed.

Here, in this embodiment, the compression ratio CRh for the second region Rh is set to a compression ratio higher than a compression ratio by which knocking can be suppressed when the operation is performed by homogenous combustion under the same operation state (engine load). FIG. 8 indicates the compression ratio by which the knocking can be suppressed in the case by the homogenous combustion by a two-dot chain line. As described above, in this embodiment, the compression ratio CRh for the second region Rh is a compression ratio higher than the compression ratio in the case by the homogenous combustion indicated by the two-dot chain line by the constant value. With regard to the second region Rh, to "set the compression ratio CRh to the compression ratio lower than the first region Rl" refers to that "lower than the first region Rl" as a general tendency throughout the entire engine load.

Moreover, FIG. 8 illustrates a change in the excess air ratio λ. In this embodiment, the excess air ratio λ decreases from λ=2 in the first region Rl with respect to the increase in the engine load and increases to a value slightly larger than 2 at a time of shifting from the first region Rl to the second region Rh and then, decreases toward λ=2 in the second region Rh. Such a behavior of the excess air ratio λ indicated to the increase in the engine load is not an active design intention to change the excess air ratio λ itself. The decrease of the excess air ratio λ in the first region Rl is caused by adjustment for securing ignitability to the lowering of the compression ratio CRl for the purpose of suppression of knocking or in other words, by increasing correction of the fuel within a range not damaging an effect by leaning of the air-fuel mixture. And the increase in the excess air ratio λ at the time of shifting from the first region Rl to the second region Rh is adjustment that ignitability is improved by stratification of the air-fuel mixture, whereby combustion under the higher excess air ratio λ is made possible.

At S107, whether shift control is being executed or not is determined. Whether the shift control is being executed or not, or in other words, whether the shift control has been completed or not can be determined from the injection amount of the second injection operation performed during the shift control (hereinafter, referred to as a "second shift injection amount" in some cases) FQt2.

In this embodiment, after the shift control is started, the fuel in an amount larger than the injection amount FQh2 at normal time of the second injection operation in the second region Rh is injected by the second injection operation, and after that, the second shift injection amount FQt2 is decreased each time the engine 1 performs a cycle so as to be gradually brought closer to the injection amount FQh2 at the normal time. Thus, when the second shift injection amount FQt2 is matched with the injection amount FQh2 at the normal time in the second region Rh, it is determined that the shift control is completed. After the shift control is completed, the engine controller 101 starts control at the normal time. Here, the injection amount FQh2 at the normal time corresponds to a "target amount in the second region" of the second injection operation.

At S108, an injection amount of the first injection operation during the shift control (hereinafter, referred to as a "first shift injection amount" in some cases) FQt1 and the second shift injection amount FQt2 are set, and fuel injection timings ITt1 and ITt2 for the shift control are set. More specifically, similarly to a calculation at a normal time which will be described later, the fuel injection amount FQ per combustion cycle according to the operation state of the engine 1 is calculated and a predetermined ratio in the calculated fuel injection amount FQ is set to the first shift injection amount FQt1, while the remaining to the second shift injection amount FQt2. Moreover, by substituting the first and second shift injection amount FQt1 and FQt2 in the aforementioned equation (1), respectively, so as to be converted to an injection period or injection pulse width Δt1a and Δt2a, and ignition timing ITt1 of the first injection operation and the ignition timing ITt2 of the second injection operation are calculated.

A ratio Ra of the first shift injection amount FQt1 in the fuel injection amount FQ for the shift control is calculated as a ratio obtained by subtracting a correction value ΔR from a ratio R (90%, for example) set at a normal time (Ra=R−ΔR). Then, the relatively large correction value ΔR is set immediately after start of the shift control, in other words, immediately after a shift from the first region Rl to the second region Rh, and the correction value ΔR is decreased each time the number of execution times of the shift control is increased, whereby the first shift injection amount FQt1 is gradually increased from the fuel injection amount immediately after the start of the control, and the second shift injection amount FQt2 can be brought closer to the injection amount FQh2 at the normal time.

In this embodiment, the second shift injection amount FQt2 is made 20% of the entire fuel injection amount FQ by setting the correction value ΔR set as a value changing within a range from 0 to 0.1 and by setting the correction value ΔR to 0.1 immediately after start of the shift control, and the second shift injection amount FQt2 is decreased to 10% of the entire fuel injection amount FQ by decreasing the correction value ΔR to 0 in accordance with the increase in the number of control execution times. Then, at a point of time when the correction value ΔR reaches 0, the shift control is determined to be completed. If the second injection operation fails in the middle of the shift control, and the fuel is not injected, the shift control is interrupted, and the routine may be proceeded to control at the normal time. In that case, a second shift injection amount $FQt2_{n-1}$ set in the routine one cycle before the failed session of the second injection operation is set to the injection amount FQh2 at the normal time.

The fuel injection timings ITt1 and ITt2 for the shift control can be set on the basis of the injection timings ITh1 and ITh2 of the first and second injection operations at the normal time.

At S109, ignition timing Igt for the shift control is set. In this embodiment, the ignition timing Igt for the shift control is set on the basis of the ignition timing Igh at the normal time.

At S110, the fuel injection amounts FQh1 and FQh2 and the fuel injection timings ITh1 and ITh2 at the normal time for the second region Rh are set. More specifically, similarly to the first region Rl, the basic fuel injection amount FQbase according to the operation state of the engine 1 is calculated, and by applying correction according to the cooling water temperature Tw and the like to the basic fuel injection amount FQbase, the fuel injection amount FQ per combustion cycle is calculated. Then, a predetermined ratio (90%, for example) in the calculated fuel injection amount FQ is set to the injection amount FQh1 of the first injection operation, and the remaining to the fuel injection amount FQh2 of the second injection operation. Moreover, the fuel injection amounts FQh1 and FQh2 of the first and the second injection operation are substituted in the aforementioned equation (1), respectively, and converted to the injection periods or the injection pulse widths Δt1 and Δt2, and the fuel injection timing ITh1 of the first injection operation and the fuel injection timing ITh2 of the second injection operation are calculated. Distribution of the fuel injection amounts FQh1 and FQh2 at the normal time and the calculation of the fuel injection timings ITh1 and ITh2 can be also made by searching from a map determined in advance by adaptation through experiments and the like similarly to the basic fuel injection amount FQbase.

At S111, the ignition timing Igh for the second region Rh at the normal time is set. In the second region Rh, the ignition timing Igh and an interval from the fuel injection timing ITh2 to the ignition timing Igh are set so that combustion is generated in the entire cylinder by using the fuel injected in the second injection operation (fuel injection timing ITh2) as a source, and a peak in heat generation can come at timing slightly after a compression top dead center point. More specifically, the ignition timing Igh is set at the timing during the compression stroke later than the ignition timing Igl in the first region Rl or immediately before the compression top dead center point in this embodiment.

In this embodiment, the "controller" is configured by the engine controller 101, and the "control device for direct fuel injection engine" is configured by the ignition plug 6, the fuel injection valve 7, and the engine controller 101. In the flowchart illustrated in FIG. 7, a function of an "operation state detection unit" is realized by processing at S101, a function of a "combustion state control unit" is realized by processing at S102, 104, 107, 108, and 110, and a function of an "ignition control unit" is realized by processing at S105, 109, and 111.

FIGS. 9 to 12 illustrate specific contents of the shift control according to this embodiment by time charts.

Settings of the injection timing ITt2 and the ignition timing Igt of the second injection operation in the shift control will be described with reference to FIGS. 9 to 12. In this embodiment, the injection timing ITt1 of the first injection operation is set to the injection timing ITh1 of the first injection operation at the normal time immediately after start of the shift control.

Figure 9:
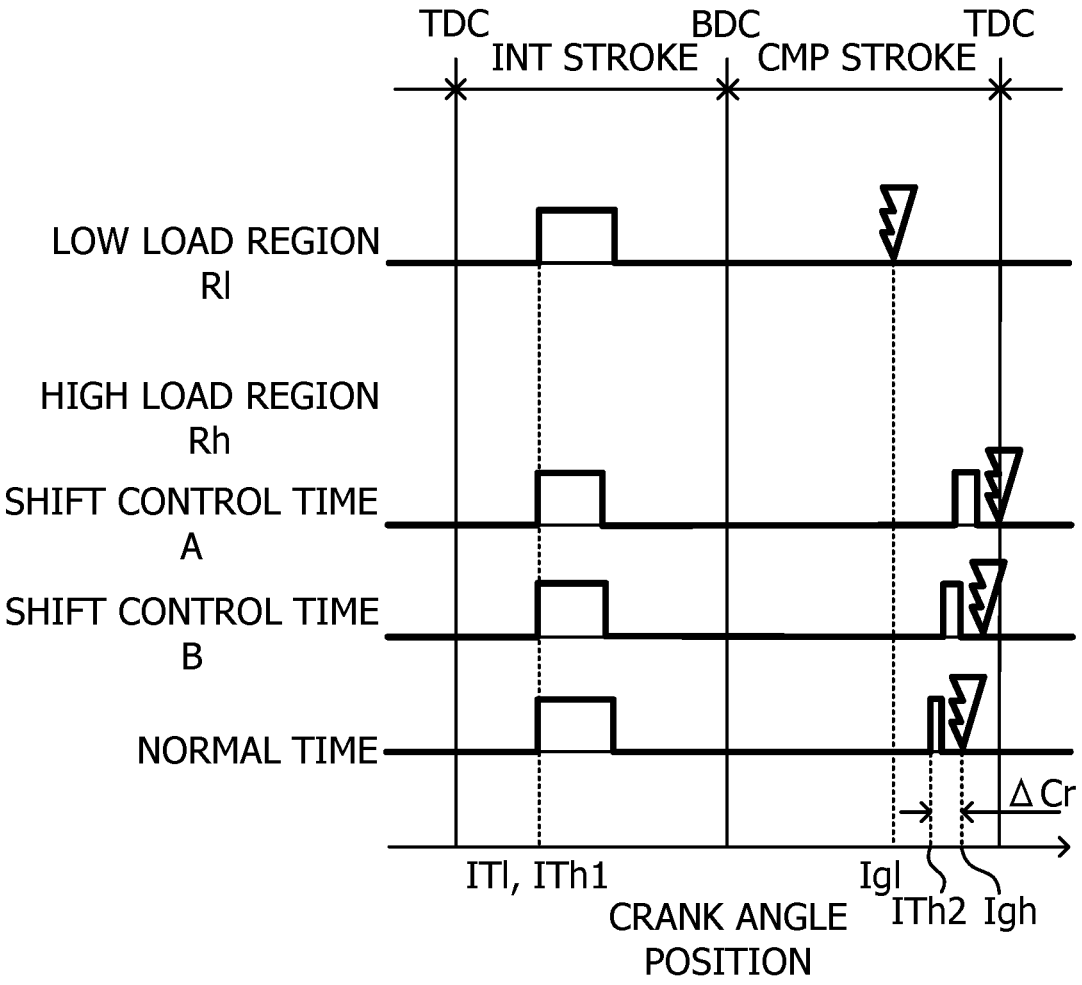
FIG. 9 is an explanatory view illustrating a specific example of control (shift control) executed at a time of shifting region.

In an example illustrated in FIG. 9, an interval ΔCr from the injection timing ITt2 of the second injection operation to the ignition timing Igt is made constant in relation to a crank angle throughout the entire control period from start to end of the shift control. On the other hand, the ignition timing Igt is retarded later than the ignition timing Igh at the normal time which is a target ignition timing in the second region Rh and then, advanced in accordance with a decrease in the second shift injection amount FQt2 and is brought closer to the ignition timing Igh at the normal time. Since the interval ΔCr from the injection timing ITt2 of the second injection operation to the ignition timing Igt is constant, the injection timing ITt2 of the second injection operation is also advanced in accordance with the advance of the ignition timing Igt.

Figure 10:
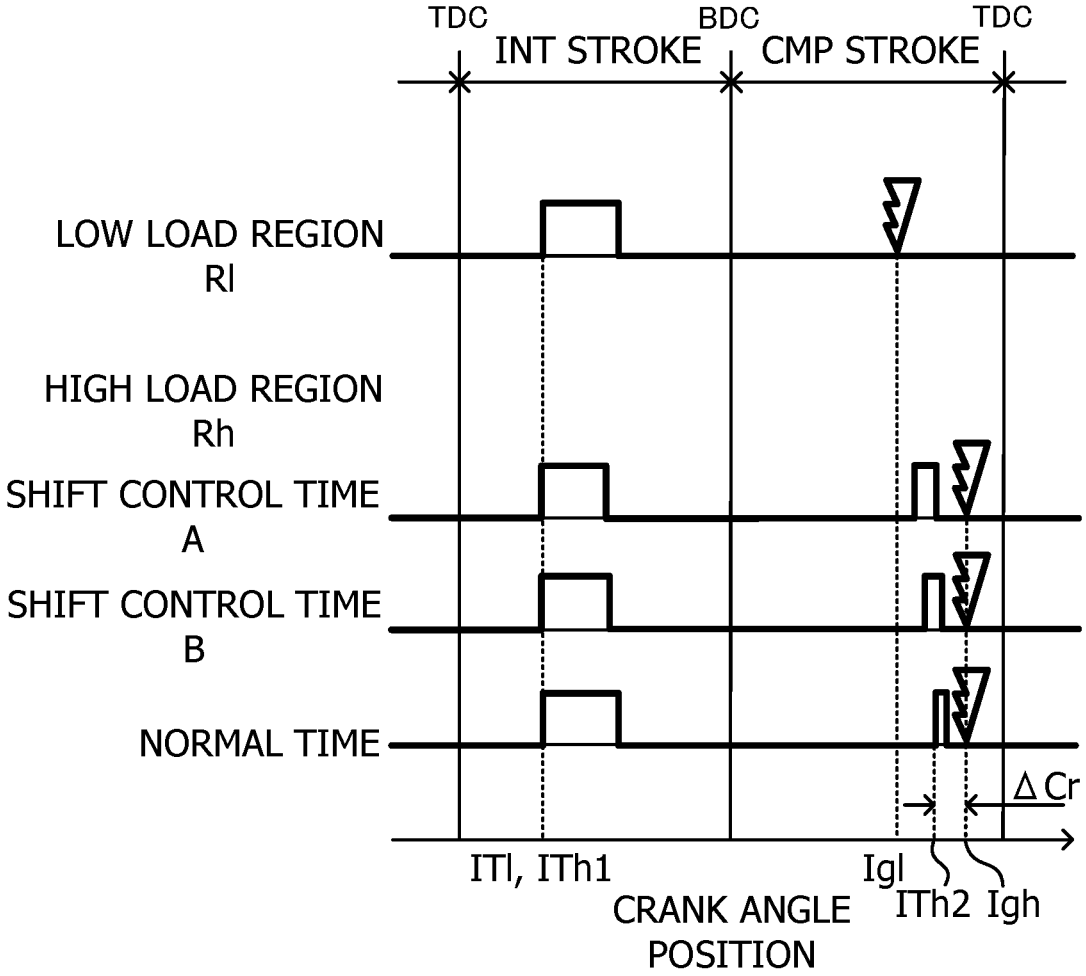
FIG. 10 is an explanatory view illustrating another example of the shift control.

In an example illustrated in FIG. 10, the ignition timing Igt of the ignition plug 6 is set to the ignition timing Igh at the normal time immediately after the start of the shift control and is held at a constant crank angle position throughout the entire control period of the shift control. On the other hand, the interval ΔCr from the injection timing ITt2 of the second injection operation to the ignition timing Igt is reduced from a relatively wide interval immediately after the start of the shift control in accordance with the decrease of the second shift injection amount FQt2. Since the ignition timing Igt is constant, the injection timing ITt2 of the second injection operation is retarded in accordance with the reduction of the interval ΔCr.

Figure 11:
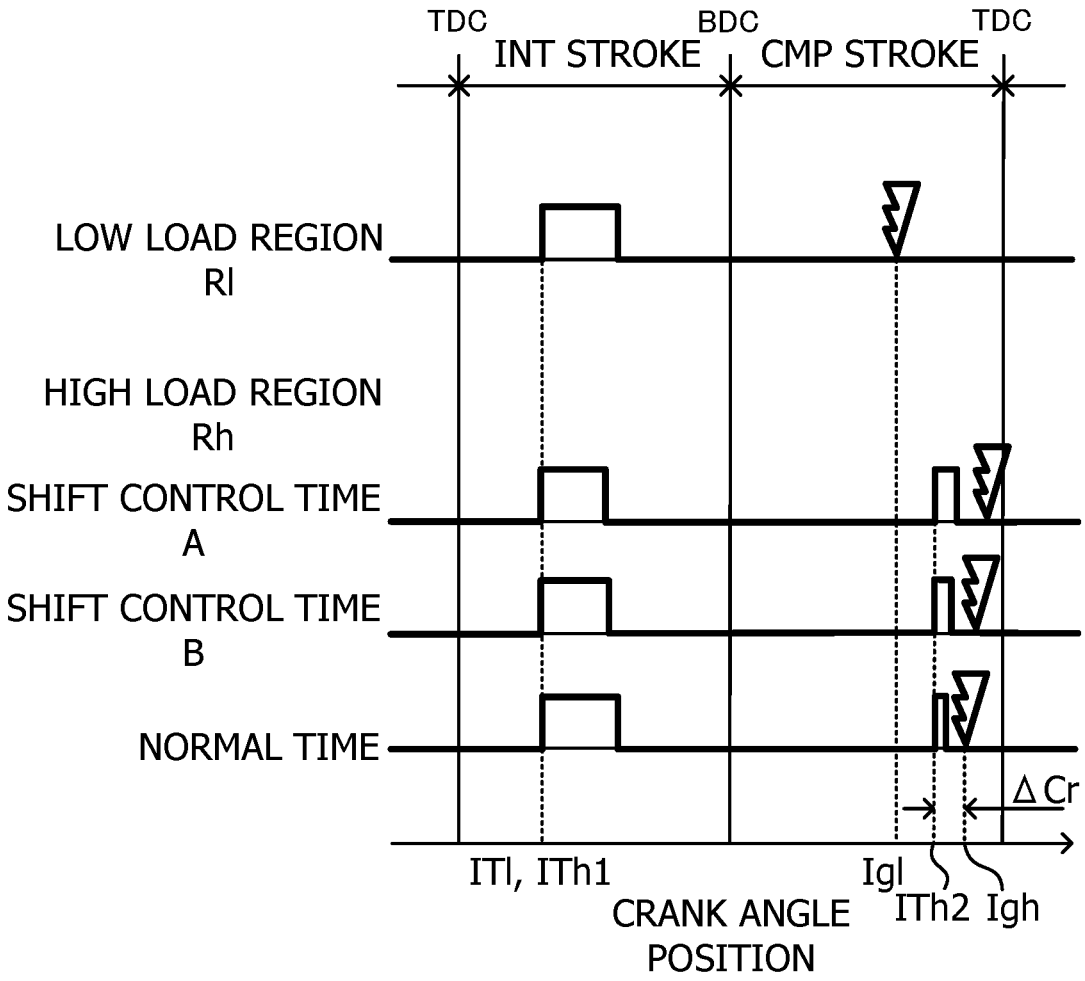
FIG. 11 is an explanatory view illustrating still another example of the shift control.

In an example illustrated in FIG. 11, the injection timing ITt2 of the second injection operation is set to the injection timing ITh2 at the normal time immediately after the start of the shift control and is held at the constant crank angle position throughout the entire control period of the shift control. On the other hand, the interval ΔCr from the injection timing ITt2 to the ignition timing Igt of the ignition plug 6 is reduced from a relatively wide interval immediately after the start of the shift control in accordance with the decrease of the second shift injection amount FQt2. Since the injection timing ITt2 is constant, the injection timing Igt at a crank angle position on the retarded angle side immediately after the start of the shift control is advanced in accordance with the reduction of the interval ΔCr.

Figure 12:
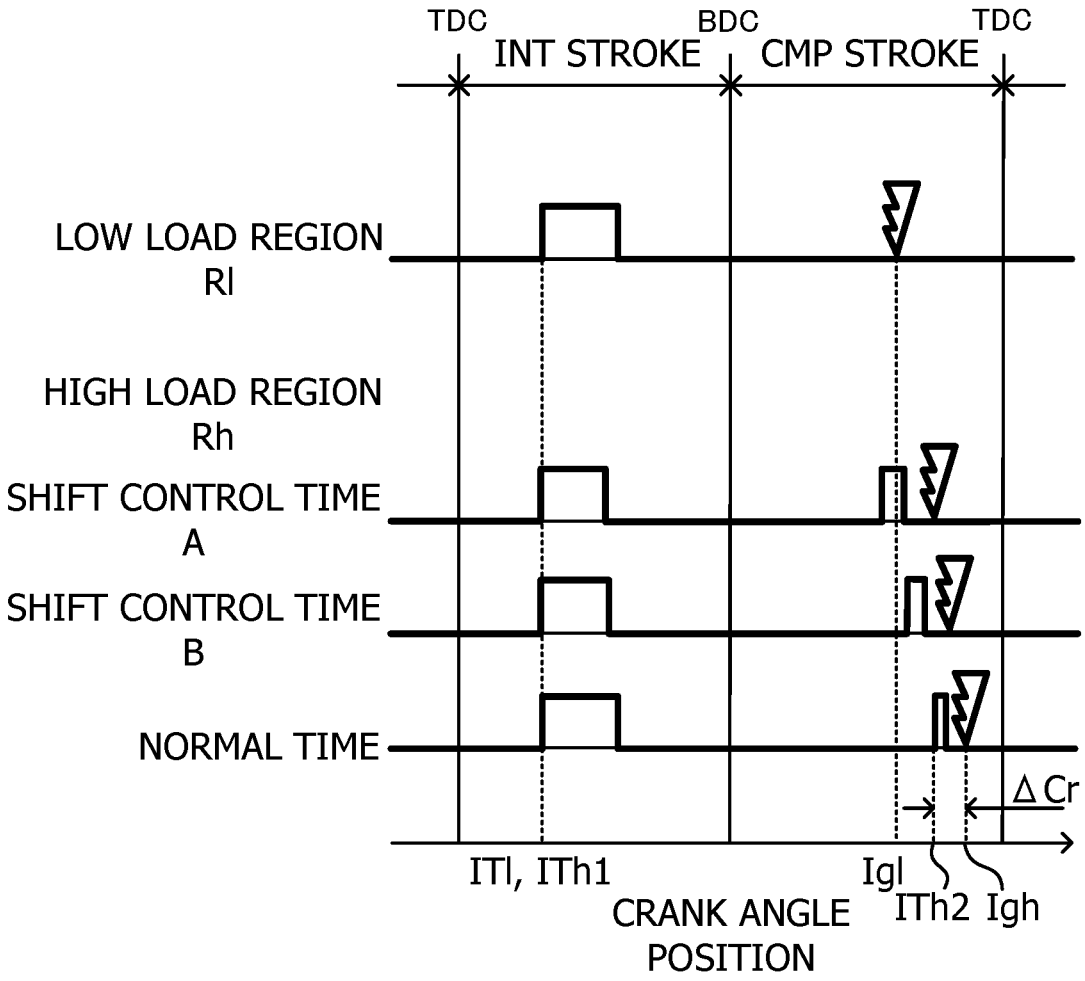
FIG. 12 is an explanatory view illustrating still another example of the shift control.

In an example illustrated in FIG. 12, the ignition timing Igt of the ignition plug 6 is gradually retarded from the ignition timing Igl for the first region Rl toward a target ignition timing in the second region Rh (ignition timing Igh at the normal time) and at the same time, the interval ΔCr from the injection timing ITt2 of the second injection operation to the ignition timing Igt is reduced from a relatively wide interval immediately after the start of the shift control in accordance with the decrease of the second shift injection amount FQt2. By means of the reduction of the interval ΔCr, a retarded amount per control execution cycle becomes larger at the injection timing ITt2 than at the ignition timing Igt.

Contents of the combustion control according to this embodiment have been described above, and effects obtained by this embodiment will be summarized below.

Description of Working Effects

First, in the first region Rl on the low load side, homogenous combustion is performed, while in the second region Rh on the high load side, since anti-knocking performance of the combustion is improved by switching the combustion form and performing the stratified combustion, the knocking can be suppressed without excessively depending on the retarding of the ignition timing. As a result, high heat efficiency can be realized over the entire operation region through improvement of the heat efficiency particularly in the second region Rh.

And by executing the shift control by the stratified combustion at a time of shifting the region from the first region Rl to the second region Rh, by injecting the fuel in an amount larger than a target amount (injection amount FQh2 at the normal time) of the second injection operation in the second region Rh and then, by decreasing the injection amount FQt2 of the second injection operation toward the target amount, the second injection operation of a relatively small amount is made executable reliably, the fuel in an amount required for ensuring combustion stability is injected, and the combustion form can be switched without losing the combustion stability.

Secondly, by setting the excess air ratio λ of the air-fuel mixture to the vicinity of 2 in both the first region Rl and the second region Rh, combustion with high heat efficiency can be realized, and a fuel cost can be reduced.

Thirdly, in the second region Rh, by retarding the ignition timing Igh of the ignition plug 6 later than the ignition timing Igl in the first region Rl, the peak timing of heat generation by the combustion can be set appropriately with regard to the position relationship with the piston 2 or more specifically, can be set to a crank angle position slightly after the compression top dead center point. And by performing the second injection operation by the target amount immediately before the ignition timing Igh, a flow is generated in the air-fuel mixture in the vicinity of the ignition plug 6 by the kinetic energy of the fuel spray injected by the second injection operation, and by performing ignition while the disturbance remains, formation of an initial flame is aided, and the combustion can be made stable.

Fourthly, by making the interval ΔCr from the injection timing ITt2 of the second injection operation to the ignition timing Igt constant (FIG. 9), combustion can be generated stably. And after the ignition timing Igt is retarded later than the ignition timing at the normal time (target ignition timing) Igh, the ignition timing Igt is advanced in accordance with the decrease in the injection amount FQt2 of the second injection operation and is brought close to the target ignition timing Igh, whereby excessive steepness of the combustion can be avoided with respect to the increase in the fuel injection amount FQt2 to the target amount FQh2.

As described above, by retarding the ignition timing Igt with respect to the increase in the injection amount FQt2 of the second injection operation, excessive steepness of the combustion can be avoided. The suppression of the combustion by retarding of the ignition timing Igt is not limited to the example illustrated in FIG. 9 but can be also achieved by making the injection timing ITt2 of the second injection operation constant, while by reducing the interval ΔCr from the injection timing ITt2 of the second injection operation to the ignition timing Igt in accordance with the decrease in the injection amount FQt2 of the second injection operation from the interval immediately after the shift to the second region Rh (FIG. 11).

Moreover, the suppression of the combustion to the increase in the injection amount FQt2 of the second injection operation can be achieved not only by retarding of the ignition timing Igt but also by changing the interval ΔCr from the injection timing ITt2 of the second injection operation to the ignition timing Igt as illustrated in FIGS. 10 and 12. More specifically, the ignition timing Igt is made constant, while the interval ΔCr from the injection timing ITt2 to the ignition timing Igt is reduced in accordance with the decrease in the injection amount FQt2 of the second injection operation from the interval immediately after the shift to the second region Rh (FIG. 10) or to retard the ignition timing Igt from the ignition timing Igl in the first region Rl toward the target ignition timing Igh in the second region Rh and to reduce the interval ΔCr from the injection timing ITt2 to the ignition timing Igt in accordance with the decrease in the injection amount FQt2 of the second injection operation from the interval immediately after the shift to the second region Rh (FIG. 12).

Fifthly, the knocking can be suppressed without depending on the retarding of the ignition timing by making the compression ratio CR of the engine 1 changeable and by lowering the compression ratio CR (=CRh) in the second region Rh on the high load side more than in the first region Rl on the low load side.

Here, if the compression ratio CR is lowered, not only that the heat efficiency is lowered but ignitability is deteriorated by the lowering of an in-cylinder temperature, whereby combustion is made unstable. On the other hand, ignitability can be ensured by lowering the excess air ratio λ of the air-fuel ratio and by relatively increasing the fuel amount in the air-fuel mixture. However, in this case, not only that the effect of improvement of the fuel efficiency by leaning of the air-fuel mixture is lessened but also that there is a concern that the NOx emission is increased.

In this embodiment, since the anti-knocking performance of the combustion is improved by performing the stratified combustion in the second region Rh, the knocking can be suppressed with a compression ratio higher than that by the homogenous combustion, and the fuel consumption rate can be reduced. FIG. 8 illustrates that the fuel consumption rate ISFC can be reduced as compared with the case using the homogenous combustion (the fuel consumption rate of the case using the homogenous combustion is indicated by a two-dot chain line) by performing the stratified combustion for the second region Rh. And since ignitability can be ensured by stratifying the air-fuel mixture without lowering the excess air ratio λ, high heat efficiency can be maintained.

Figure 13:
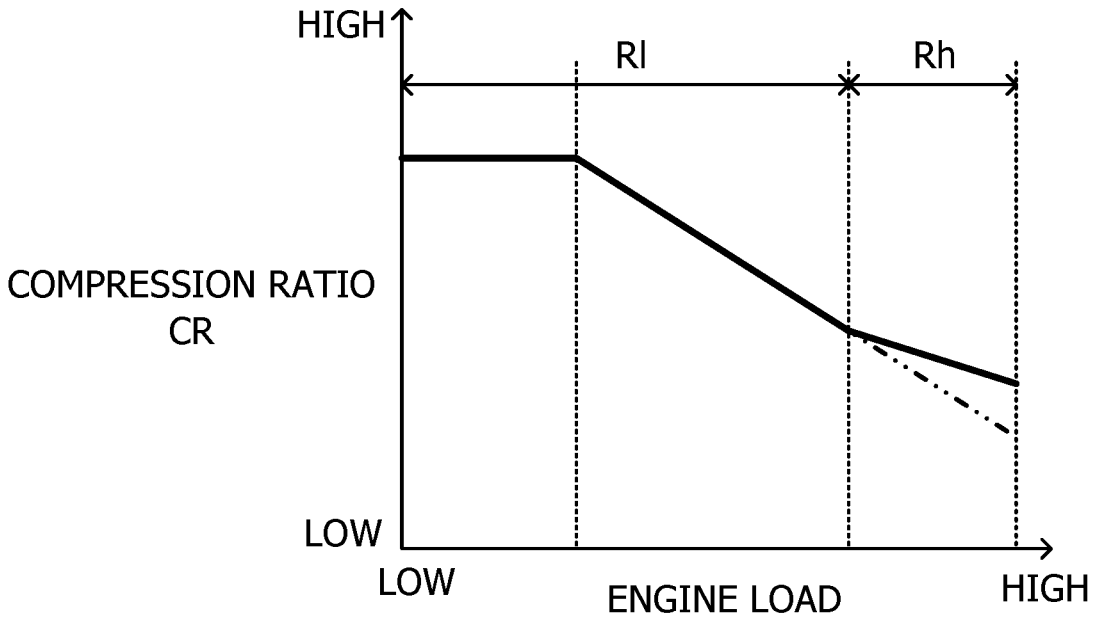
FIG. 13 is an explanatory view illustrating a change example of a change in the compression ratio to the engine load.

In this embodiment, as illustrated in FIG. 8, the compression ratio CR is increased in steps at the time of shifting from the first region Rl to the second region Rh with respect to the increase in the engine load (however, in actual driving, there is a delay according to characteristics of the actuator 39 and the link mechanisms 31, 32, 33 and the like in an operation of the variable compression ratio mechanism). The compression ratio CRh for the second region Rh is not limited to such setting but may be continuously changed with respect to the increase in the engine load. As illustrated in FIG. 13, the compression ratio CRh is changed in the second region Rh so that a difference from the compression ratio capable of suppressing knocking (indicated by the two-dot chain line) by the homogenous combustion is increased with respect to the increase in the engine load, for example.

The embodiment of the present invention has been described, but the aforementioned embodiment only illustrates a part of the application example of the present invention and is not intended to limit the technical range of the present invention to the specific configuration of the aforementioned embodiment. Various changes and modifications of the aforementioned embodiment are possible within a range of the matters described in claims.

The invention claimed is:

1. A control method of a direct fuel-injection spark ignition engine including an ignition plug and a fuel injection valve arranged to be capable of injecting a fuel directly in a cylinder, wherein in a first region on a low load side of an operation region of the engine, homogenous combustion is performed, while, in a second region of the operation region on a load side higher than the first region, stratified combustion is performed, in stratified combustion the a fuel is dispersed in a cylinder by a first injection operation of the fuel injection valve and a fuel is unevenly distributed in a vicinity of the ignition plug by a second injection operation of the fuel injection valve;

shift control by the stratified combustion is executed at a time of shifting the operation region when an operation state of the engine has shifted from the first region to the second region; and in the shift control, a fuel in an amount larger than a target amount of the second injection operation in the second region is injected in the second injection operation by controlling a ratio of the injection amounts by the first injection operation and the second injection operation occupied in a fuel injection amount per combustion cycle and then, an injection amount of the second injection operation is decreased toward the target amount.

2. The control method of a direct fuel-injection spark ignition engine according to claim 1, wherein in both the first region and the second region, an excess air ratio of an air-fuel mixture is set in a vicinity of 2.

3. The control method of a direct fuel-injection spark ignition engine according to claim 1, wherein the first injection operation is performed during an intake stroke, and the second injection operation is performed in a compression stroke.

4. The control method of a direct fuel-injection spark ignition engine according to claim 1, wherein in the second region, an ignition timing later than the ignition timing in the first region is set as a target ignition timing of the ignition plug; and the second injection operation by the target amount is performed immediately before the target ignition timing.

5. The control method of a direct fuel-injection spark ignition engine according to claim 4, wherein in the shift control, an interval from an injection timing of the second injection operation to the ignition timing of the ignition plug is made constant; and the ignition timing is retarded later than the target ignition timing and then, is advanced toward the target ignition timing in accordance with a decrease in the injection amount of the second injection operation.

6. The control method of a direct fuel-injection spark ignition engine according to claim 4, wherein in the shift control, the ignition timing of the ignition plug is set to the target ignition timing; and an interval from an injection timing of the second injection operation to the ignition timing is reduced from an interval immediately after a shift to the second region in accordance with a decrease in the injection amount of the second injection operation.

7. The control method of a direct fuel-injection spark ignition engine according to claim 4, wherein in the shift control, an injection timing of the second injection operation is made constant; and an interval from the injection timing of the second injection operation to the ignition timing of the ignition plug is reduced from an interval immediately after a shift to the second region in accordance with a decrease in the injection amount of the second injection operation.

8. The control method of a direct fuel-injection spark ignition engine according to claim 4, wherein in the shift control, the ignition timing of the ignition plug is retarded from an ignition timing in the first region toward the target ignition timing; and an interval from an injection timing of the second injection operation to the ignition timing of the ignition plug is reduced from an interval immediately after a shift to the second region in accordance with a decrease in the injection amount of the second injection operation.

9. The control method of a direct fuel-injection spark ignition engine according to claim 1, wherein the engine is configured to be capable of changing a compression ratio thereof; and the compression ratio is set lower in the second region than in the first region.

10. The control method of a direct fuel-injection spark ignition engine according to claim 1, wherein in the second region, a compression ratio is set higher than a compression ratio at which knocking of the engine is suppressed under a situation that an operation is performed by the homogenous combustion under a same operation state.

11. A control device for a direct fuel-injection spark ignition engine comprising:

an ignition plug;

a fuel injection valve arranged to be capable of injecting a fuel directly in a cylinder; and a controller configured to control operation of the ignition plug and the fuel injection valve, wherein the controller is configured to:

detect an operation state of the engine;

control a combustion state in the cylinder on a basis of the operation state of the engine; and set an ignition timing of the ignition plug; and the controller:

causes the engine to perform an operation by homogenous combustion when the operation state of the engine is in a first region on a low load side and causes the engine to perform an operation by stratified combustion when the operation state is in a second region on a load side higher than the first region, in the stratified combustion a fuel injected by a first injection operation of the fuel injection valve is dispersed in a cylinder and a fuel injected by a second injection operation of the fuel injection valve is unevenly distributed in a vicinity of the ignition plug;

executes shift control by the stratified combustion at a time of shifting the operation region when the operation state of the engine has shifted from the first region to the second region; and in the shift control, causes a fuel in an amount larger than a target amount of the second injection operation in the second region to be injected in the second injection operation by controlling a ratio of the injection amounts by the first injection operation and the second injection operation occupied in a fuel injection amount per combustion cycle and then, causes an injection amount of the second injection operation to be decreased toward the target amount.

* * * * *